US005328136A

United States Patent [19]

Müller et al.

[11] Patent Number: 5,328,136

[45] Date of Patent: Jul. 12, 1994

[54] METHOD AND DEVICE FOR POSITIONING THE BEGINNING OF A WEB OF MATERIAL, ESPECIALLY A WEB OF PAPER, AGAINST THE ROLL OF A WINDER FROM BELOW

[75] Inventors: Georg Müller, Neuss; Heinz Hofferberth, Düsseldorf, both of Fed. Rep. of Germany

[73] Assignee: Jagenberg Aktiengesellschaft, Dusseldorf, Fed. Rep. of Germany

[21] Appl. No.: 692,807

[22] Filed: Apr. 25, 1991

Related U.S. Application Data

[63] Continuation of Ser. No. 368,470, Jun. 19, 1989, abandoned.

[30] Foreign Application Priority Data

Jun. 21, 1988 [DE] Fed. Rep. of Germany ..... 3820846

[51] Int. Cl.[5] ..... B65H 18/08; B65H 20/14

[52] U.S. Cl. ..... 242/541.3; 226/97

[58] Field of Search ..... 242/67.1 R, 56 R, 56 A, 242/195, 67.2; 226/95, 97

[56] References Cited

U.S. PATENT DOCUMENTS 3,844,189 10/1974 Jardine ..... 242/56 A X

FOREIGN PATENT DOCUMENTS 2413614 8/1978 Fed. Rep. of Germany .
3117094 11/1982 Fed. Rep. of Germany .
3102894 1/1983 Fed. Rep. of Germany .
3820846 12/1989 Fed. Rep. of Germany .

*Primary Examiner*—Daniel P. Stodola
*Assistant Examiner*—John P. Darling
*Attorney, Agent, or Firm*—Sprung Horn Kramer & Woods

[57] ABSTRACT

An apparatus for positioning the beginning of a web of material, especially paper, against the roll of a winder from below. The beginning of the web is conveyed up against an upright plate-shaped web-positioning mechanism by compressed air. The compressed air is emitted in an essentially laminar flow up along the surface of and essentially parallel with the surface of a baffle.

6 Claims, 1 Drawing Sheet

Figure 1:
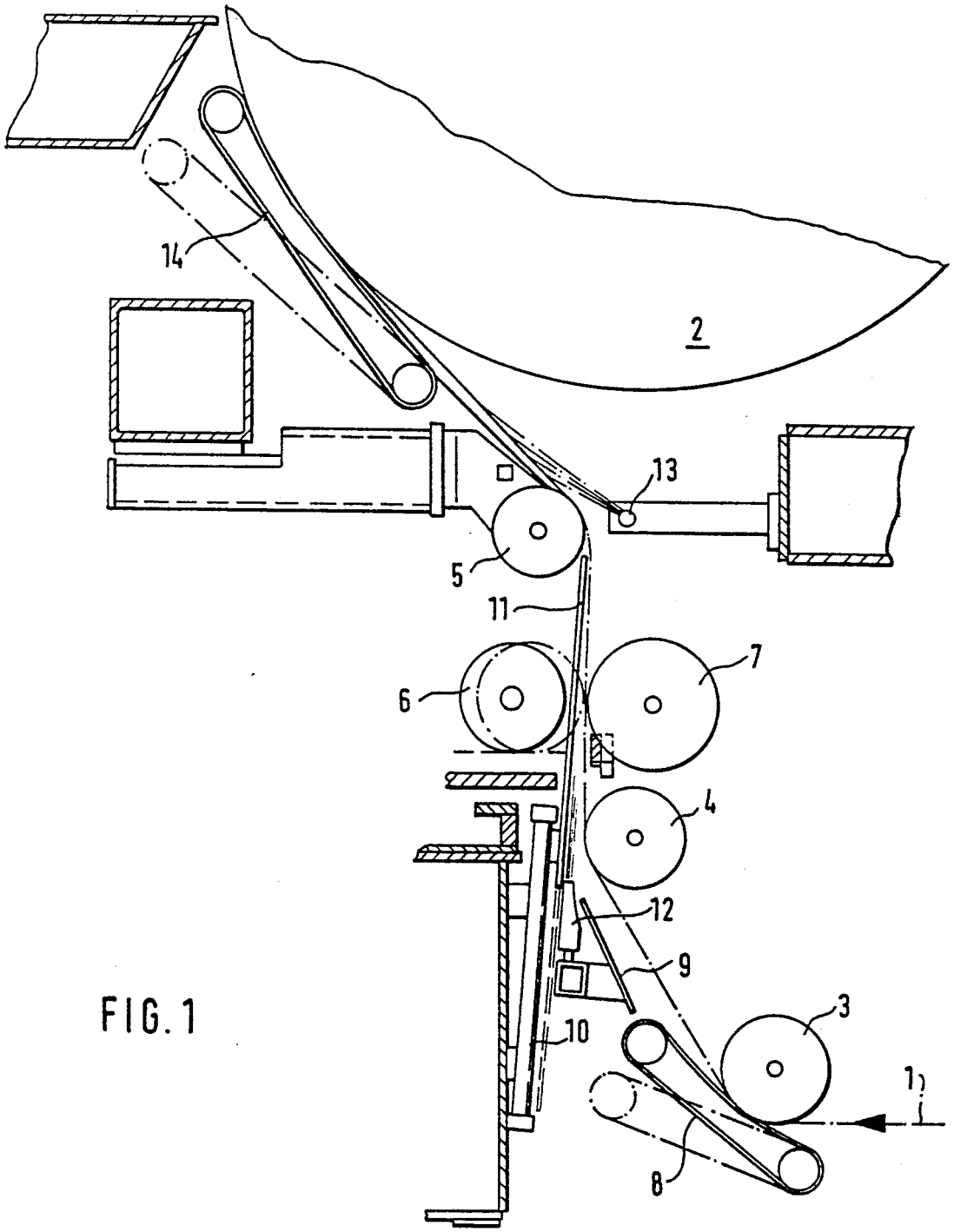

METHOD AND DEVICE FOR POSITIONING THE BEGINNING OF A WEB OF MATERIAL, ESPECIALLY A WEB OF PAPER, AGAINST THE ROLL OF A WINDER FROM BELOW

This application is a continuation of application Ser. No. 368,470, filed Jun. 19, 1989, now abandoned.

The invention concerns both a method of positioning the beginning of a web of material, especially a web of paper, against the roll of a winder from below and a device for carrying out the method.

It is relatively time-consuming to introduce a fresh web of paper, when a supply reel is replaced or when the web tears for example, into winders wherein the web arrives at the individual rewinding stations from below. With backing-roll winders, an operator must climb down into the difficult to reach space under the backing roll and below the floor manually to guide the beginning of the web straight up through the slitter at that point and position it against the bottom of the backing roll. The slitter knives can be separated only slightly for this purpose. The beginning of the web is then guided farther on to the rewinding station by the backing roll, which has suction openings for that purpose and is subjected to vacuum while the fresh web is being introduced. A backing-roll winder wherein the web is introduced from below is described in German Patent 3 102 894.

German OS 3 117 094 describes a method of this general type wherein compressed air flows against the web and/or with at least one component of the current paralleling the direction that the web is traveling in, out of a number of openings in a web-positioning plate that parallels the direction of web travel and moves up and down. The method described therein, however, has turned out to be unsatisfactory in practice. Even when considerable volumes of air are supplied at high pressure, the device disclosed therein is unable reliably to convey the beginning of the web straight up over the requisite distance.

One object of the present invention is to provide a method of the same general type that will ensure reliable straight-up conveyance with as little compressed air as possible. Another object is to provide a device for carrying out a method in accordance with the invention.

The first object is attained by emitting the compressed air in an essentially laminar flow up along the surface of and essentially parallel with the surface of a baffle. This will ensure reliable conveyance of the beginning of the web.

A second object is attained by providing an upright baffle that extends over part of the operating width of the winder roll, and at least one flat-jet nozzle with several air-emergence openings that parallel the baffle and open upward, the openings being less than about 10 mm away from the baffle. Advantageously the nozzle openings are about 0.5 to 1 mm away from the baffle and about 3 to 5 flat-jet nozzles are spaced across the width of the baffle.

Air-emergence openings less than about 2 mm in diameter decrease the pressure needed to convey the beginning of the web, while permitting the baffle to be moved up and down to allow the web to be guided between the knives of a slitter.

The simplified drawing is intended to explain the invention with reference to one embodiment by way of example.

FIG. 1 is a schematic side view of a device in accordance with the invention.

Part of a winder is illustrated in FIG. 1. A web 1 of material, paper, is supplied from below to a backing roll 2 in the form of a suction roll. The web of paper is guided by three leading rolls 3, 4, and 5. Web 1 arrives more or less horizontally from an unillustrated unwinder and is deflected up by leading roll 3, upright by leading roll 4, and at a tangent to backing roll 2 by leading roll 5.

A slitter with several pairs of circular knives that parallel the axis of the backing roll is positioned where the web is traveling upright between leading rolls 4 and 5. The pairs, which consist of male knives 6 and female knives 7, slit web 1 into separate webs, and male knives 6 can be moved slightly apart from female knives 7.

The function of the additional mechanisms that will now be described is automatically to position the beginning of a fresh web against backing roll 2.

A belt 8 that can be pivoted in against the circumference of leading roll 3 and a baffle 9 that is aligned with the belt divert the beginning of the web toward leading roll 4. In the vicinity of leading roll 4 is another baffle 11 that extends perpendicular over part of the operating width, that can be moved up and down by a piston-and-cylinder mechanism 10, and that extends, when it is in its upper position, from leading roll 4 to leading roll 5 between knives 6 and 7. When baffle 11 is in its lower position, its upper edge is approximately as high as leading roll 4. The baffle 11 in the present embodiment is positioned halfway across the direction of travel and, since it is intended to position the beginning of a web that is approximately 300 to 400 mm wide, is approximately 500 mm wide.

Distributed at regular intervals between baffle 11 and baffle 9 and over the width of baffle 11 are flat-jet nozzles 12, supplied from an unillustrated source of compressed air. Nozzles 12 are approximately 50 mm wide and have several adjacent openings approximately 1 mm in diameter, through which the compressed air emerges in a laminar flow. The design of such flat-jet nozzles is described in principle in German OS 2 413 614. The position of nozzles 12 and hence the direction that the air flows in is of decisive significance to conveying web 1 straight up. There are three such nozzles in the present example and they are positioned parallel with and very close to baffle 11. It has been demonstrated that the air-emergence openings must be less than 10 mm and preferably between 0.5 and 1 mm away from baffle 11.

At the top of the upright section of the path of the web and in the vicinity of leading roll 5, another nozzle 13 diverts the beginning of the web along a tangent to backing roll 2. To ensure that the beginning of the web will come to rest against backing roll 2, another belt 14 that can be pivoted against the backing roll is positioned on that side.

While the individual webs that have been created by slitter 6 and 7 are being wound on reels resting against the top of backing roll 2, the mechanisms that introduce the beginning of a fresh web are disengaged and cannot impede the web as it travels and is wound.

Thus, pivoting belts 8 and 14 have been pivoted away from their associated rolls 3 and 2, baffle 11 is in its lowermost position outside of slitter 6 and 7 with male knife 6 resting in the operating position against female knife 7, and nozzles 12 and 13 are not in operation.

To position the beginning of a fresh web, when there is a fresh supply reel in the unwinder for example, knives 6 and 7 are separated to allow baffle 11 to move into its upper position. In this position it extends along the overall path that the beginning of the fresh web must be advanced along. Belts 8 and 14 are also applied against rolls 3 and 2, and compressed air is supplied to nozzles 12 and 13.

The width of the beginning of the fresh web is decreased in the vicinity of the unwinder to approximately 300 to 400 mm by tearing off its edges. The accordingly narrowed section is more or less as long as the path between leading roll 3 and backing roll 2, approximately 1500 mm in the present case. The beginning of the fresh web is then advanced from the unwinder to leading roll 3 by means of unillustrated conveyor belts, whence it is deflected up over baffle 9 and into the vicinity of the current of air from flat-jet nozzles 12 by pivoted-in belt 8.

Since they are so close to baffle 11, nozzles 12 direct the compressed air in a laminar flow up along the surface of the baffle. Since the air is flowing more rapidly than the beginning of the web is advancing, a vacuum occurs between baffle 11 and web 1 that forces the web directly against the baffle. The rough surface of the paper also generates a force component that is directed straight up and acts on the web, conveying web 1 up in a motion that is supported by the conveyor belts.

Once the beginning of the web arrives in the vicinity of leading roll 5, it is deflected toward pivoting belt 14 by the air flowing out of nozzle 13 and forced by the belt against backing roll 2. As soon as enough of the beginning of the web resting against the backing roll can be secured by the suction, belts 8 and 14 pivot down again, baffle 11 returns to its lower position, and knives 6 and 7 move into the operating position. Once the beginnings of the fresh individual webs have been secured to cores, the speed of the winder can be accelerated to its maximum.

It will be understood that the specification and examples are illustrative but not limitative of the present invention and that other embodiments within the spirit and scope of the invention will suggest themselves to those skilled in the art.

What is claimed is:

1. In a web winding apparatus including a winder roll, and means for positioning the beginning of a web of material against said roll, said means including an upright plate-shaped web-positioning mechanism and a supply of compressed air to convey the beginning of a web against said mechanism, the improvement which comprises an upright baffle that extends over part of the operating width of said roll, and at least one flat-jet nozzle with several air-emergence openings that parallel the baffle and open upward, the openings being about 0.5 to 1 mm away from the baffle, whereby the compressed air passes in an essentially laminar flow up along the surface of and essentially parallel with the surface of the baffle.

2. An apparatus according to claim 1, wherein about 3 to 5 flat-jet nozzles are spaced across the width of the baffle.

3. An apparatus according to claim 1, wherein the air-emergence openings of the flat-jet nozzles are less than about 2 mm in diameter.

4. An apparatus according to claim 1, wherein the air-emergence openings of the flat-jet nozzles are less than about 1 mm in diameter.

5. An apparatus according to claim 1, including means for moving the baffle up and down.

6. In a web winding apparatus including a winder roll, and means for positioning the beginning of a web of material against said roll, said means including an upright plate-shaped web-positioning mechanism and a supply of compressed air to convey the beginning of a web against said mechanism, the improvement which comprises an upright baffle that extends over part of the operating width of said roll, and at least one flat-jet nozzle with several air-emergence openings that parallel the baffle and open upward, the openings being less than 10 mm away from the baffle, whereby the compressed air passes in an essentially laminar flow up along the surface of and essentially parallel with the surface of the baffle.

* * * * *